United States Patent [19]

Zimmer et al.

[11] 4,402,156

[45] Sep. 6, 1983

[54] COIN-OPERATED BANK

[76] Inventors: Edward P. Zimmer, 4545 Chestnut Ridge Rd., Apt. 110A, Williamsville, N.Y. 14221; Joseph F. Cardinal, 1744 Colvin Blvd., Tonawanda, N.Y. 14223

[21] Appl. No.: 294,197

[22] Filed: Aug. 19, 1981

[51] Int. Cl.[3] ..... A63H 33/00

[52] U.S. Cl. ..... 46/4; 273/119 A

[58] Field of Search ..... 46/4, 3, 2, 5, 248, 46/269; 273/119 A, 123 A, 126 A, 124 A, 85 A

[56] References Cited

U.S. PATENT DOCUMENTS

| | | | |
|---|---|---|---|
| 376,628 | 1/1888 | Bowen | 46/4 |
| 2,448,951 | 9/1948 | Baum | 46/4 |
| 3,243,914 | 4/1966 | Poynter | 46/4 X |
| 3,512,298 | 5/1970 | Poynter | 46/3 |
| 3,841,017 | 10/1974 | Heble | 46/4 |

FOREIGN PATENT DOCUMENTS

| | | | |
|---|---|---|---|
| 660669 | 5/1938 | Fed. Rep. of Germany | 273/85 A |

*Primary Examiner*—Mickey Yu

*Attorney, Agent, or Firm*—Christel, Bean & Linihan

[57] ABSTRACT

A toy bank of the coin-operated type including a housing having a coin storage region and an external action surface, a coin-receiving opening in the surface communicating with the storage region, an electrically-operated coin propelling mechanism carried by the housing for moving a coin along the surface and through the opening, and a pair of electrical contacts carried by the housing connected in controlling relation to the propelling mechanism and positioned to receive a coin placed thereon to bridge the contacts. When the coin is placed on both contacts it completes an electrical circuit through the coin to operate the propelling mechanism to move the coin along the action surface through the opening and into the storage region. The propelling mechanism can comprise an electric motor and coin striking member fixed to the motor shaft. The striking member can simulate an athletic game player such as a hockey player and the coin receiving opening can simulate the game scoring area such as a hockey net.

9 Claims, 2 Drawing Figures

COIN-OPERATED BANK

BACKGROUND OF THE INVENTION

This invention relates to toy coin banks, and more particularly to a new and improved coin bank of the coin-operated type.

A coin bank of the type where placement of the coin at one location on the bank initiates an action sequence to move the coin to a storage area in the bank enhances the enjoyment of the user, and is particularly desirable for children. An important consideration in the design of such a bank is minimizing the number of movable parts to increase the wear life and lower the cost of manufacture. The foregoing must be accomplished in a manner which maintains the fun and enjoyment of the users of the toy bank.

SUMMARY OF THE INVENTION

It is, therefore, a primary object of this invention to provide a new and improved toy coin bank of the coin-operated type.

It is a further object of this invention to provide such a bank wherein the placement of a coin at one location in the bank initiates an action sequence to move the coin to a storage area in the bank.

It is a more particular object of this invention to provide such a bank wherein the coin itself is utilized to complete an electrical circuit to operate the bank in an action sequence.

It is a further object of this invention to provide such a bank having relatively fewer moving parts yet providing adequate enjoyment and fun for the users.

The present invention provides a toy bank of the coin operated-type including a housing having a coin storage region and an external action surface, a coin-receiving opening in the surface communicating with the storage region, electrically-operated coin propelling means carried by the housing for moving a coin along the surface and through the opening, and a pair of electrical contacts carried by the housing connected in controlling relation to the propelling means and positioned to receive a coin placed thereon to bridge the contacts. When a coin is placed on both contacts the coin completes an electrical circuit to operate the propelling means to move the coin along the action surface through the opening and into the storage region. The propelling means can comprise an electric motor and striking member fixed to the motor shaft, the striking member can simulate an athletic game player, such as a hockey player, and the coin receiving opening can simulate the game scoring area such as a hockey net.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 1 is an exploded perspective view of a toy coin bank according to the present invention; and FIG. 2 is a schematic circuit diagram of the electrical circuit of the bank of FIG. 1.

DETAILED DESCRIPTION OF THE ILLUSTRATED EMBODIMENT

Figure 1:
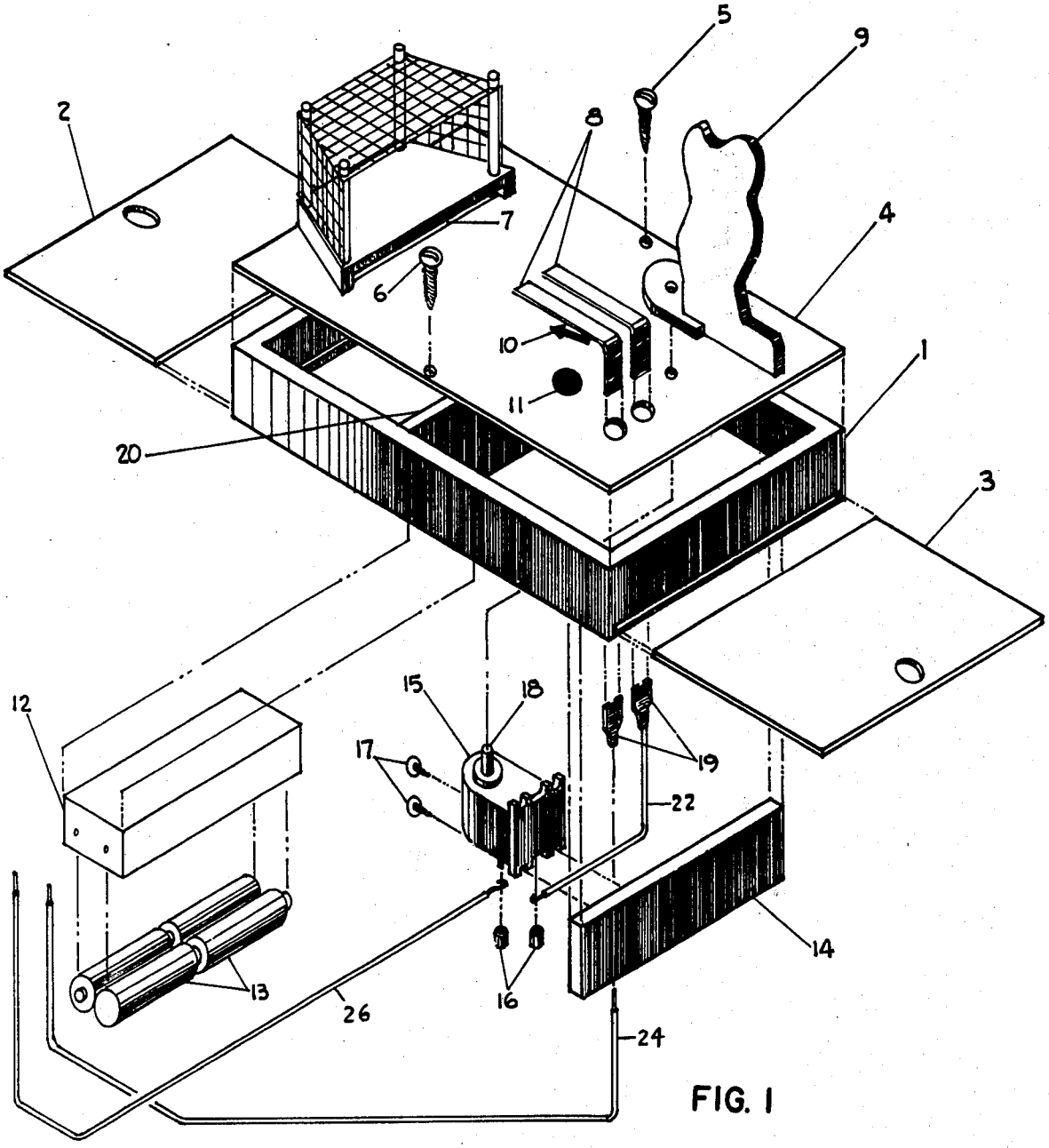

Referring now to FIG. 1, the toy coin bank of the present invention comprises a housing adapted to be supported during use, such as on a table or counter, which housing has a hollow interior defining a coin storage region or reservoir and has a surface defining a coin handling area and provided with an opening therein in communication with the coin storage region and of a size allowing a coin to pass therethrough. The base construction 1 serves as the basic support structure and housing unit for the bank. A sliding panel 2 slides into grooves at the bottom of base construction 1 and butts up to a spacer 20. The panel 2 prevents the coin which has dropped through the opening beneath the guide simulating a hockey goal net 7 from falling out of the base construction 1. When it is desired to withdraw accumulated coins from the bank, panel 2 simply is moved by hand away from spacer 20. The top plate 4 is secured to the base construction 1 by suitable means, for example screws 5 and 6. This top plate 4 serves as a mounting surface and an action or playing area or coin handling area for the bank. The hockey net 7 is glued or otherwise fixed to the top plate 4 and extends over the opening in the plate 4 into which the coins fall to be saved. The structure defining net 7 serves as a guide for directing coins moving along surface 4 through the opening and into the coin storage region. The housing and guide can be of any suitable material, for example plastic or wood.

The toy coin bank of the present invention further comprises electrically-operated coin propelling means carried by the housing for moving a coin along the coin handling surface and through the opening therein in response to completion of an electrical circuit operatively associated with the propelling means. A pair of electrical contacts is carried by the housing and connected electrically to the circuit and positioned to receive a coin placed thereon to bridge the contacts thereby completing the electrical circuit through the coin. The coin propelling means preferably comprises an electric motor and a coin striking member fixed to the motor shaft. The pair of switch contacts 8, position indicating arrow 10, and coin position locating spot 11 are suitably fixed such as by glue to the top plate 4. The coin striking member 9 is shaped to simulate a hockey player and is pressure fitted to the output shaft 18 of a battery-operated d.c. motor 15 so that member 9 is positioned approximately ⅛ inch above the top plate 4. This ⅛ inch distance allows the hockey player 9 ample room to swivel forward and backward above the top plate 4 and the switch contacts 8. The striking member 9 can be of various suitable materials, such as wood or plastic. A battery housing 12 is mounted to the underside of the top plate 4. A motor mount panel 14 is connected to the inside of the base construction 1 and serves as the mounting surface for the motor 15 which is secured to the panel 14 by suitable means such as screws 17.

Two wire fasteners 19 are pressure fitted to the protruding ends of the switch contacts 8. One of the wires 22 from one of the switch contacts 8 leads to the motor 15 and is fastened to the motor 15 by a motor contact cap 16. The other wire 24 from the other switch contact 8 is wired to the one polarity terminal of the batteries 13 in housing 12. To complete the proper electrical connections a wire 26 is connected between the motor 15 and the opposite polarity terminal of batteries in housing 12. Another sliding panel 3 slips into the base construction 1 and serves as a dust cover for the motor 15 and the batteries 13.

Figure 2:
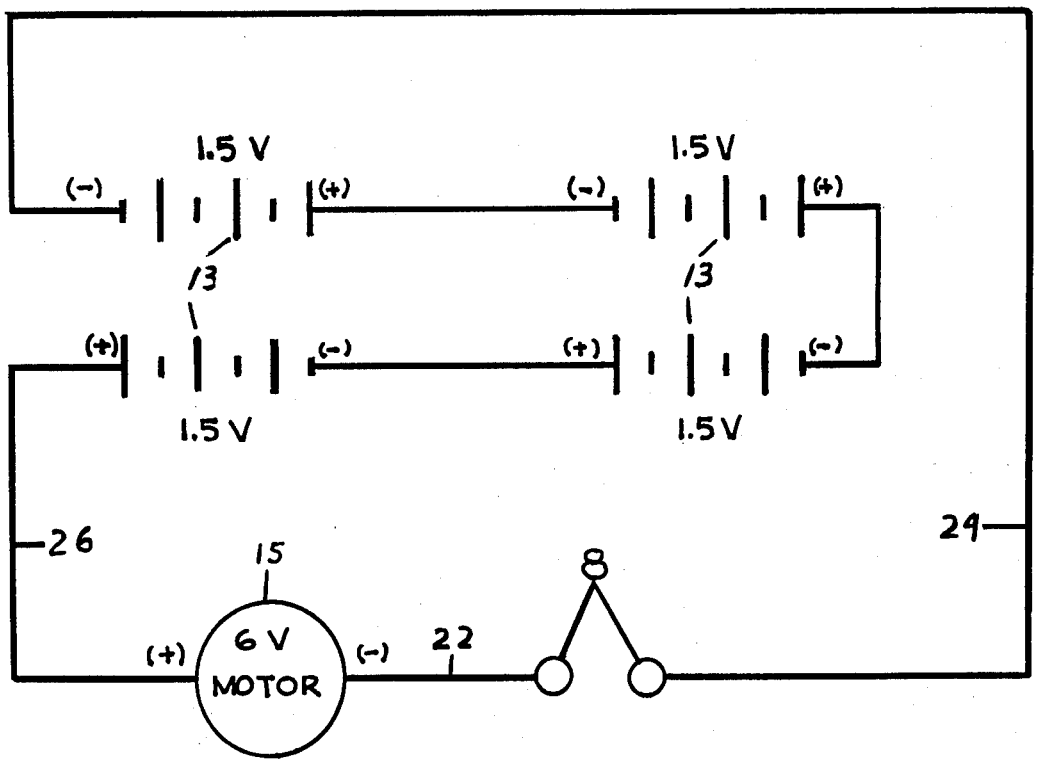

FIG. 2 illustrates further the electrical circuit of the toy bank of the present invention. Four 1.5 volt batteries 13 are connected in series to a 6 volt D.C. motor. The circuit to the 6 volt motor can be completed only when a coin is placed on the edges of the switch contacts 8. Once the coin has been properly placed, it acts as the switch, completing the circuit and activating the motor.

The toy coin bank of the present invention is used in the following manner. First, the hockey player 9 is rotated manually in either direction and brought to rest directly over the position arrow 10. This is the desired position for the hockey player 9 to achieve a maximum arc when the motor 15 is activated. Next, the user of the bank drops a coin over the coin position spot 11 which is located between the switch contacts 8. When the coin has been dropped properly over the coin position spot 11, the edges of the coin will come to rest on top of the two switch contacts 8. This procedure completes the electrical circuit between the motor 15 and the batteries 13. The motor 15 is immediately activated and its shaft 18 spins in a clockwise direction causing the hockey player 9 to spin simultaneously in the same direction. The hockey player 9 moving in a clockwise direction has enough clearance to move over part of the switch contacts 8 until the hockey player 9 reaches the coin which is resting on the switch contacts 8. The clockwise motion of the hockey player 9 has enough momentum generated by the motor 15 to clear the coin from its path, sweeping it across the top plate 4 and into the hockey net 7 where upon it drops down into the coin storage region in the base construction 1. As soon as the coin has lost contact with the switch contacts 8 the electrical circuit is broken and the motor 15 is immediately deactivated causing the hockey player 9 to come to rest again.

Thus, there is provided a motorized battery operated mechanical bank which affords the operator a fun way to save money. The bank can easily be distinguished from others in that the coin not only acts to switch the motor on but it serves as a functional component of the switch itself. When properly placed into position, the coin has current conducted through it, completing an electrical circuit with the result that the motor is turned on. The motor, by means of the striker member shaped like a hockey figure attached to its shaft, removes the coin thereby breaking the circuit and shutting the motor off. This concept of the coin becoming the switch which is activated and deactivated immediately simplifies the mechanics of the electrical mechanical bank of the present invention compared to any need for the use of a switch with movable parts to complete a circuit. The coin being a constant solid will always conduct the current. There are no movable parts to break down. Conventional switches containing movable parts or components are subject to all the normalities of common switch failure such as wear, physical damage, stress, etc. In addition, with the coin being a functional part of the bank and the need to position it properly on the contacts, this increases the involvement of the user and the bank becomes even more enjoyable and fun to use, especially by children.

It is therefore apparent that the present invention accomplishes its intended objects. While an embodiment of the present invention has been described in detail, this is for the purpose of illustration, not limitation.

We claim:

1. A toy coin bank comprising:

(a) a housing adapted to be supported during use having a hollow interior defining a coin storage region and having a surface defining a coin handling area;

(b) an opening in said surface in communication with said coin storage region and of a size allowing a coin to pass therethrough;

(c) electrically-operated coin propelling means carried by said housing for moving a coin along said surface and through said opening in response to completion of an electrical circuit operatively associated with said propelling means;

(d) a pair of electrical contacts carried by said housing connected electrically to said circuit and positioned to receive a coin placed thereon to bridge said contacts thereby completing said electrical circuit through said coin; and (e) said coin propelling means comprising an electric motor located within said housing and positioned with the output shaft thereof disposed generally perpendicular to said surface defining said coin handling area and a coin striking member fixed to said shaft for rotation therewith about an axis generally perpendicular to said surface and into engagement with said coin from said contacts along said surface toward said opening;

(f) whereby when a coin is placed by the user on said contacts said electrical circuit is completed through said coin thereby operating said propelling means to move the coin from said contacts along said surface and through said opening into said storage region.

2. A coin bank according to claim 1, wherein said contacts are located in spaced relation on said surface, the distance between said contacts allowing a coin to be placed thereon and simultaneously contact both, said motor shaft and coin striking member being located near said contacts such that in the initial or rest position said striking member is out of engagement with said coin and in response to operation of said motor said striking member moves along an arc into striking engagement with said coin to propell said coin toward said opening.

3. A coin bank according to claim 1, wherein said coin striking member is shaped to simulate a player of an athletic game.

4. A coin bank according to claim 1, wherein said electric motor is a d.c., battery-operated motor and further including a battery carried by said housing and electrically connected to said circuit.

5. A coin bank according to claim 1, further including a guide on said surface operatively associated with said opening for directing moving coins therethrough.

6. A coin bank according to claim 5, wherein said guide has a structure simulating the scoring area of an athletic game.

7. A coin bank according to claim 1, wherein said housing is provided with an additional opening in communication with said coin storage region which additional opening is normally closed by a removable closure element which can be removed to permit withdrawl of coins stored in said bank.

8. A coin bank according to claim 1, wherein said housing is hollow rectangular in shape having a base adapted to be placed on a supporting surface during use and wherein said surface defining said coin handling area is disposed generally parallel to said base and generally horizontally during use.

9. A coin bank according to claim 1, wherein said surface defining said coin handling area is generally rectangular with said opening being located near one end, said contacts being located near the other end, and said coin propelling means is located near said contacts.

* * * * *